US007637325B2

(12) United States Patent
Goonetilleke et al.

(10) Patent No.: US 7,637,325 B2
(45) Date of Patent: Dec. 29, 2009

(54) SUBSEA TREES AND CAPS FOR THEM

(75) Inventors: Cecil C Goonetilleke, Kuala Lumpur (MY); Oystein Mogedal, Oslo (NO); Knut Mogedal, Asker (NO)

(73) Assignee: Aker Subsea Limited, Berkshire (GB)

( * ) Notice: Subject to any disclaimer, the term of this patent is extended or adjusted under 35 U.S.C. 154(b) by 0 days.

(21) Appl. No.: 12/089,739

(22) PCT Filed: Oct. 17, 2006

(86) PCT No.: PCT/GB2006/003843

§ 371 (c)(1),
(2), (4) Date: Apr. 10, 2008

(87) PCT Pub. No.: WO2007/054664

PCT Pub. Date: May 18, 2007

(65) Prior Publication Data

US 2008/0210435 A1 Sep. 4, 2008

(30) Foreign Application Priority Data

Nov. 9, 2005 (GB) ..... 0522772.3

(51) Int. Cl.
*E21B 29/12* (2006.01)

(52) U.S. Cl. ..... 166/368; 166/75.13; 166/341

(58) Field of Classification Search ..... 166/356, 166/368, 341, 342, 343, 79.1, 97.1, 75.13, 166/88.4, 360
See application file for complete search history.

(56) References Cited

U.S. PATENT DOCUMENTS 4,378,848 A * 4/1983 Milberger ..... 166/351
4,405,016 A * 9/1983 Best ..... 166/337
4,497,369 A * 2/1985 Hurta et al. ..... 166/368
5,005,650 A * 4/1991 Hopper ..... 166/339
5,010,956 A * 4/1991 Bednar ..... 166/344

(Continued)

FOREIGN PATENT DOCUMENTS

GB 2 319 544 5/1998

(Continued)

OTHER PUBLICATIONS

Great Britain Search Report dated Jan. 24, 2006.

(Continued)

*Primary Examiner*—Thomas A Beach
(74) *Attorney, Agent, or Firm*—Nixon & Vanderhye P.C.

(57) ABSTRACT

A cap for a subsea tree having a re-entry hub (1) and for use with a tubing hanger (25) deployed within the tree comprises an outer sleeve (3) for fitment over the hub and an inner sleeve (19) adapted to extend within the hub. The sleeve has communication couplers (27, 37) for cooperation with the tubing hanger. Preferably the communication couplers are located at the extremity of the inner sleeve. The couplers can accommodate dummy plugs or live couplers to suit the mode of application. The inner sleeve (19) supports at least one annular seal (21, 22) which provides a barrier between the inner sleeve and the inner periphery of the hub. The outer sleeve (19) includes releasable engagement fittings (16) for securing the outer sleeve to the hub. The cap is adapted for use as a running tool.

11 Claims, 5 Drawing Sheets

U.S. PATENT DOCUMENTS

| | | | | | |
|---|---|---|---|---|---|
| 5,107,931 | A * | 4/1992 | Valka et al. | 166/342 |
| 5,868,204 | A | 2/1999 | Pritchett et al. | |
| 5,971,077 | A * | 10/1999 | Lilley | 166/368 |
| 5,988,282 | A * | 11/1999 | Jennings et al. | 166/348 |
| 5,992,526 | A * | 11/1999 | Cunningham et al. | 166/343 |
| 6,003,602 | A | 12/1999 | Wilkins | |
| 6,050,339 | A * | 4/2000 | Milberger | 166/368 |
| 6,062,314 | A * | 5/2000 | Nobileau | 166/368 |
| 6,076,605 | A * | 6/2000 | Lilley et al. | 166/368 |
| 6,102,124 | A * | 8/2000 | Skeels et al. | 166/347 |
| 6,109,352 | A * | 8/2000 | Edwards et al. | 166/336 |
| 6,302,212 | B1 * | 10/2001 | Nobileau | 166/368 |
| 6,367,551 | B1 | 4/2002 | Fenton | |
| 6,378,613 | B1 * | 4/2002 | Kent et al. | 166/368 |
| 6,470,968 | B1 * | 10/2002 | Turner | 166/348 |
| 6,474,416 | B2 * | 11/2002 | Beall et al. | 166/343 |
| 6,508,308 | B1 * | 1/2003 | Shaw | 166/313 |
| 6,637,514 | B1 * | 10/2003 | Donald et al. | 166/368 |
| 6,675,900 | B2 * | 1/2004 | Baskett et al. | 166/379 |
| 6,681,850 | B2 * | 1/2004 | Bartlett et al. | 166/86.2 |
| 6,719,057 | B2 * | 4/2004 | Johansen | 166/332.8 |
| 6,763,891 | B2 * | 7/2004 | Humphrey et al. | 166/368 |
| 6,776,230 | B2 * | 8/2004 | Collie et al. | 166/97.1 |
| 6,817,417 | B2 * | 11/2004 | Blair et al. | 166/335 |
| 6,966,383 | B2 * | 11/2005 | Milberger et al. | 166/368 |
| 6,991,039 | B2 * | 1/2006 | Hopper et al. | 166/348 |
| 7,025,132 | B2 * | 4/2006 | Kent et al. | 166/87.1 |
| 7,069,988 | B2 * | 7/2006 | Bartlett et al. | 166/86.2 |
| 7,111,687 | B2 * | 9/2006 | Donald et al. | 166/368 |
| 7,150,325 | B2 * | 12/2006 | Ireland et al. | 166/366 |
| 7,308,934 | B2 * | 12/2007 | Swagerty et al. | 166/177.5 |
| 7,325,598 | B2 * | 2/2008 | Bartlett | 166/75.13 |
| 7,387,166 | B2 * | 6/2008 | Bartlett | 166/335 |
| 2002/0000315 | A1 * | 1/2002 | Kent et al. | 166/85.4 |
| 2002/0088622 | A1 * | 7/2002 | Beall et al. | 166/342 |
| 2003/0111228 | A1 | 6/2003 | Garrett et al. | |
| 2004/0074636 | A1 * | 4/2004 | Bartlett et al. | 166/88.2 |
| 2004/0216885 | A1 * | 11/2004 | Bartlett | 166/343 |
| 2005/0028984 | A1 * | 2/2005 | Donald et al. | 166/368 |
| 2006/0076141 | A1 * | 4/2006 | Bartlett | 166/368 |
| 2007/0289747 | A1 * | 12/2007 | Shaw et al. | 166/368 |
| 2008/0087436 | A1 * | 4/2008 | Baskett | 166/344 |
| 2008/0190621 | A1 * | 8/2008 | Huang et al. | 166/339 |

FOREIGN PATENT DOCUMENTS

| | | |
|---|---|---|
| GB | 2 321 658 | 8/1998 |
| GB | 2 405 883 | 3/2005 |
| WO | 2004/041455 | 5/2004 |

OTHER PUBLICATIONS

International Search Report for PCT/GB2006/003843 dated Feb. 16, 2007.

Written Opinion of the International Searching Authority dated Feb. 16, 2007.

* cited by examiner

SUBSEA TREES AND CAPS FOR THEM

This application is the U.S. national phase of International Application No. PCT/GB2006/003843 filed 17 Oct. 2006 which designated the U.S. and claims priority to Great Britain Application No. 0522772.3 filed 9 Nov. 2005, the entire contents of each of which are hereby incorporated by reference.

This invention relates to subsea oil and gas production and in particular to trees for the support of tubing for the extraction and oil and/or gas subsea and more particularly to an improved cap for such a tree (usually termed 'Christmas tree').

It is well known practice to complete a subsea well with a tubing hanger from which can be suspended a production tubing string. The hanger and the production tubing string are run into the tree on an assembly which usually includes a running tool. The tree usually includes an internal plug or cap that provides a barrier to production fluids above the tubing hanger. The state of the art is represented by the documents U.S. Pat. No. 6,367,551B1 and U.S. Pat. No. 5,868,204A.

The present invention is more particularly concerned with an improved multi-purpose cap for a subsea tree and particularly one for a 'horizontal Christmas tree'

One aspect of the invention is to allow configuration of the cap either to provide downhole communications or to act as blanking unit to provide a second barrier in the communication lines when the lines are taken through the body of the tree.

Another aspect of the invention is the adaptation of the cap as a handling or running tool, thereby allowing the elimination of the need for a separate running tool.

After the tree is run with the cap in running tool mode the cap would be parked sub-sea in a parking bay on the tree structure (not shown). After the tubing hanger is run and completion work is finished the cap would be removed from the parking bay and installed on the tree, thereby saving a sub-sea trip.

A further aspect of the invention is the provision of a pressure barrier to the atmosphere, thereby to avoid the need for a separate internal tree cap.

The invention provides a cap for a subsea tree having a re-entry hub, and for use with a tubing hanger deployed within the tree, comprising an outer sleeve for fitment over the hub and an inner sleeve adapted to extend within the hub, the sleeve having communication couplers for cooperation with the tubing hanger.

Preferably the communication couplers are located at the extremity of the inner sleeve. The communication couplers normally include both hydraulic couplers and electrical couplers. The couplers preferably can accommodate dummy plugs or live couplers to suit the mode of application.

Preferably the inner sleeve supports at least one annular seal which provides a barrier between the inner sleeve and the inner periphery of the hub. Each such seal may be accommodated in an annular recess in the outer periphery of the inner sleeve.

The outer sleeve preferably includes releasable engagement fittings for securing the outer sleeve to the hub.

Preferably the cap is adapted for use as a running tool. The cap may include a boss having an upwardly extending part adapted for attachment to a wire line.

The invention also provides a subsea tree including a re-entry hub, and for use with a tubing hanger which can be deployed within the tree, the tree including a cap comprising an outer sleeve for fitment over the hub and an inner sleeve adapted to extend within the hub, the inner sleeve having communication couplers for cooperation with the tubing hanger.

One example of the invention will now be described with reference to the drawings, in which.

DETAILED DESCRIPTION of an EXEMPLARY EMBODIMENT

Figure 1:
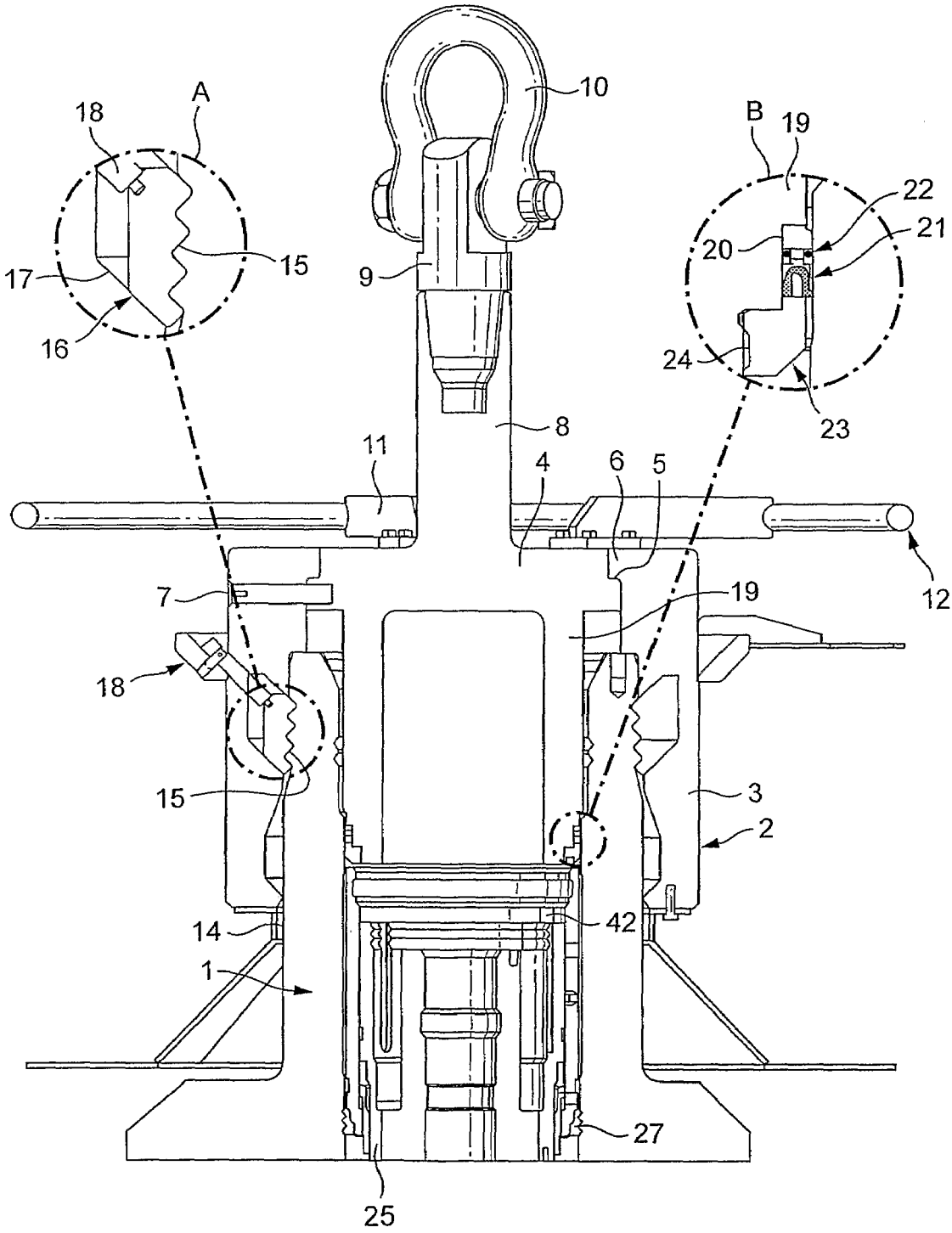
FIG. 1 is a partly sectioned view of a cap and a re-entry hub of a Christmas tree according to the invention.

Reference is made first to FIG. 1, which shows a re-entry hub 1 for a laterally accessible subsea tree (commonly known as a 'horizontal Christmas tree'). The hub is shown as fitted with a cap 2 according to the invention. The cap 2 comprises an outer sleeve 3 and a central boss 4. The boss 4 has an peripheral shoulder 5 which supports an inner rim 6 of the outer sleeve 3. The outer sleeve 3 is secured to the boss 4 of the cap 2 by means of bolts such as the bolt 7 which extends through a horizontal bore through the sleeve 2 into a bore in the boss 4. Extending axially upwardly from the boss 4 of the cap 2 is a post 8 into the end of which is secured by screw threading an anchoring lug 9 for a chain eye 10 by means of which the cap can be run by means of a wire line (not shown). The cap can also be run by means of drill pipe by engaging a drill pipe (not shown) in the thread profile in post 8.

Secured to the top surface of the boss 4 of the cap 2 by brackets 11 is a rail 12 which can support ancillary equipment (to be described).

The outer surface 14 of the hub 1 has a multi-grooved annular profile 15. This can be releasably engaged by latches carried in the outer sleeve 3 of the cap 2. One of these latches is the latch 16, shown to a larger scale by inset A. The latch 16 slides in a downwardly slanting channel 17 and can be secured in engagement with the profile 15 by means of an actuator 18. This and other similar actuators can be operated by a diver or a remote operation vehicle (ROV).

Extending downwards from the boss 4 of the cap 2 is an inner sleeve 19. The outer surface of the inner sleeve 19 has a progressively stepped profile. A first step, shown in inset B, is constituted by an annular recess 20. The annular recess 20 accommodates seals 21 sand 22. In this example, the seal 21 is a metal seal (such as an annular C-section seal) and seal 22 is an elastomeric seal. Each seal is disposed to seal between the outer periphery of the inner sleeve of the cap and the inner periphery of the re-entry hub 1. Accordingly the cap can be employed as a pressure-containing cap, thereby avoiding the need for a separate internal tree cap. The seals 21 and 22 are held in position by a retaining ring 23 which has an inner screw thread for engagement with a an external screw thread 24 below the recess 20 on the inner sleeve 19.

The inner sleeve 19 can extend into a tubing hanger lock-down actuation ring 42 on the tubing hanger 25 located within the hub 1. The actuation ring 42 has an external stepped profile which, when the hanger has been run and landed (see later), engages with a split locking ring 27 in the hub 1.

Figure 2A:
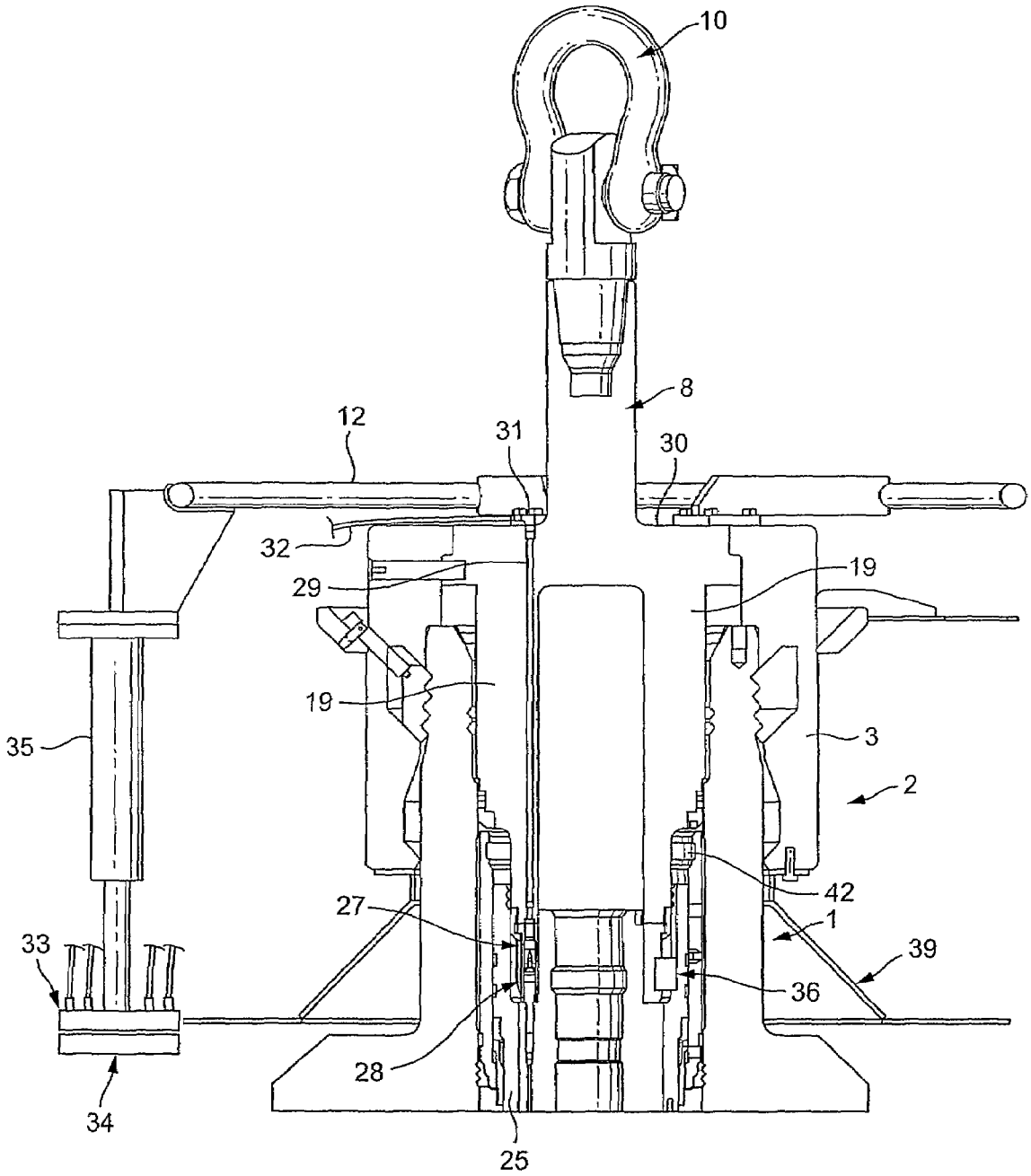
FIG. 2A is another partly sectioned view of a cap and a re-entry hub of a Christmas tree according to the invention.
Figure 2B:
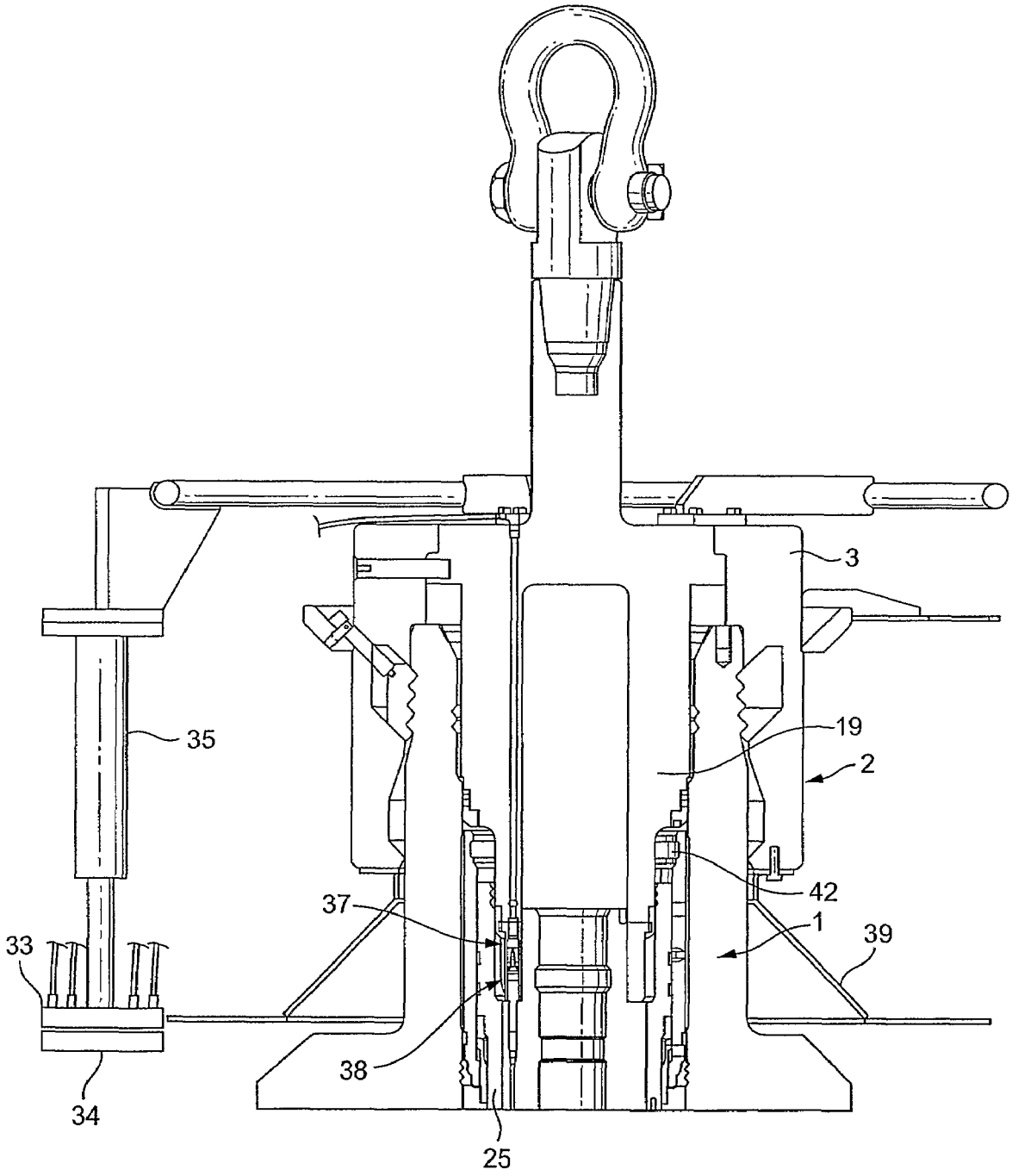
FIG. 2B is another partly sectioned view of a cap and a re-entry hub of a Christmas tree according to the invention.

FIGS. 2A and 2B illustrate how the cap 2 is adapted to provide communication for both hydraulic fluid and electrical signals with the tubing hanger 25 to provide 'down-hole' communication while running the tubing hanger. When communication is taken through the body of the tree the cap then provides an additional seal for the communication channels that would otherwise extend through the cap.

FIG. 2A illustrates particularly the couplers for hydraulic communication and FIG. 2B the couplers for electrical communication.

For hydraulic communication through the cap, the cap 2 has at the lower extremity of the inner sleeve 19 a hydraulic coupler 27 which can mate with a hydraulic coupler 28 in the tubing hanger 25. The coupler 27 in the inner sleeve 19 is in communication with a passageway 29 which extends upwards through the sleeve 19 to the top surface 30 of the boss 4 and to a joint 31 from which extends a line 32 to a coupler in a pair of coupler plates 33 and 34 suspended by means of a support 35 from the rail 12.

FIG. 2A also shows at the lower part of the inner sleeve an orientation key 36.

FIG. 2B illustrates particularly an electrical coupler 37 located at the extremity of the sleeve 19, coupled to a corresponding coupler 38 in the tubing hanger 25. In normal practice the couplers 37 and 38 are conductive couplers, though inductive couplers could theoretically be used. In particular, the coupler 37 is preferably of the 'wet-makeable' conductive type. A line from coupler. 37 extends thorough the sleeve 19 to the exterior of the cap, similar to that previously described with reference to FIG. 2A and thence to the external coupler plates 33 and 34.

FIGS. 2A and 2B also show a guide cone 39 which is used to guide the cap assembly onto the tree.

After the tubing hanger is landed and locked within the tree communications may be taken either through the cap as previously mentioned or through the body of the tree. This is illustrated particularly in FIG. 3. When communications are taken through the body of the tree, dummy plugs 40 in the cap provide an additional seal for the communication lines.

Figure 3:
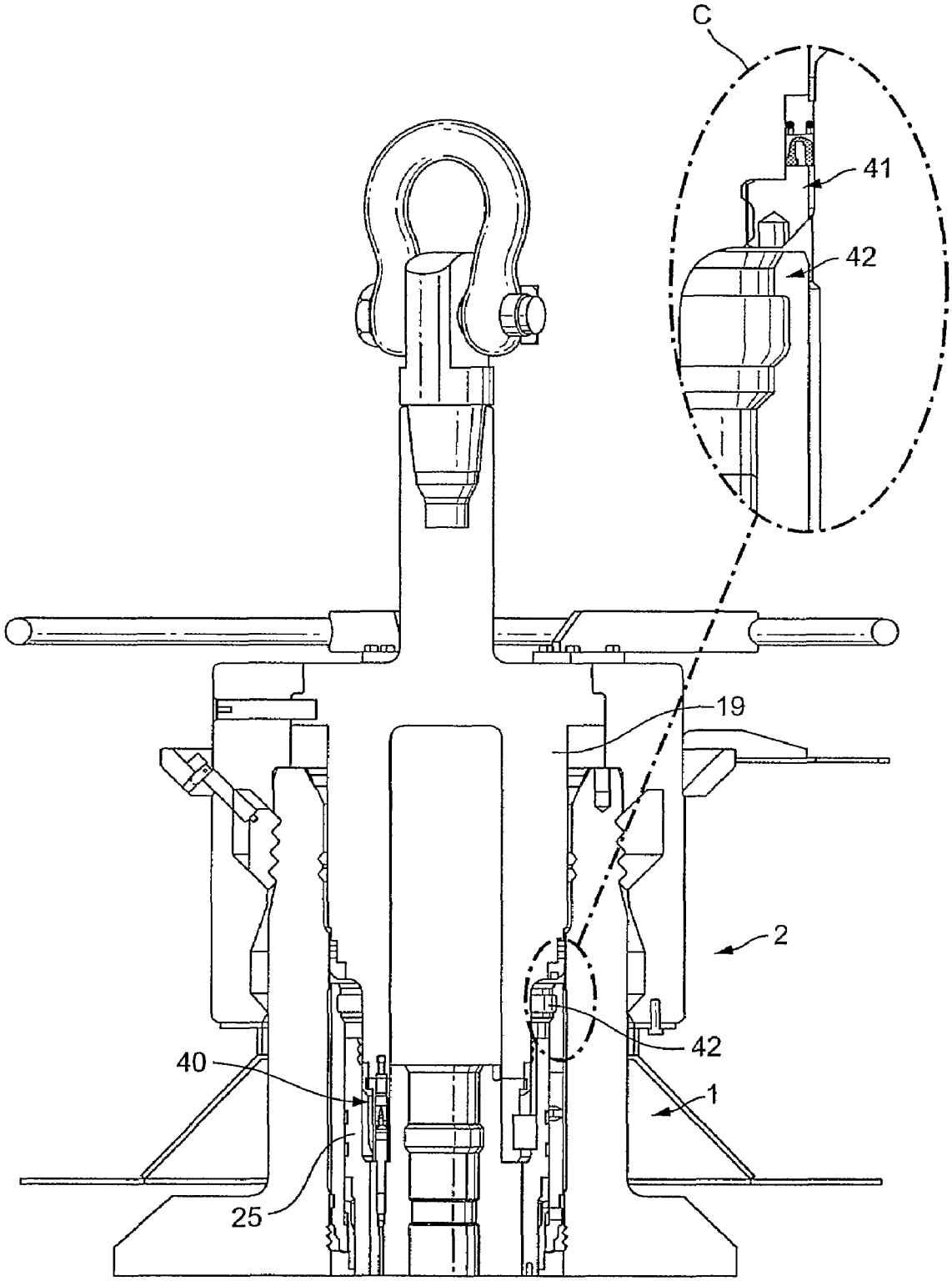
FIG. 3 is another partly sectioned view of a cap and a re-entry hub of a Christmas tree according to the invention.

When the cap is installed in the tree it provides an independent locking mechanism for the tubing hanger 25. This is achieved by virtue of the disposition of the tip 41 of the internal sleeve 19 close to the end of the tubing hanger's lockdown ring 42, as shown in FIG. 3 and to a larger scale by inset C.

Figure 4:
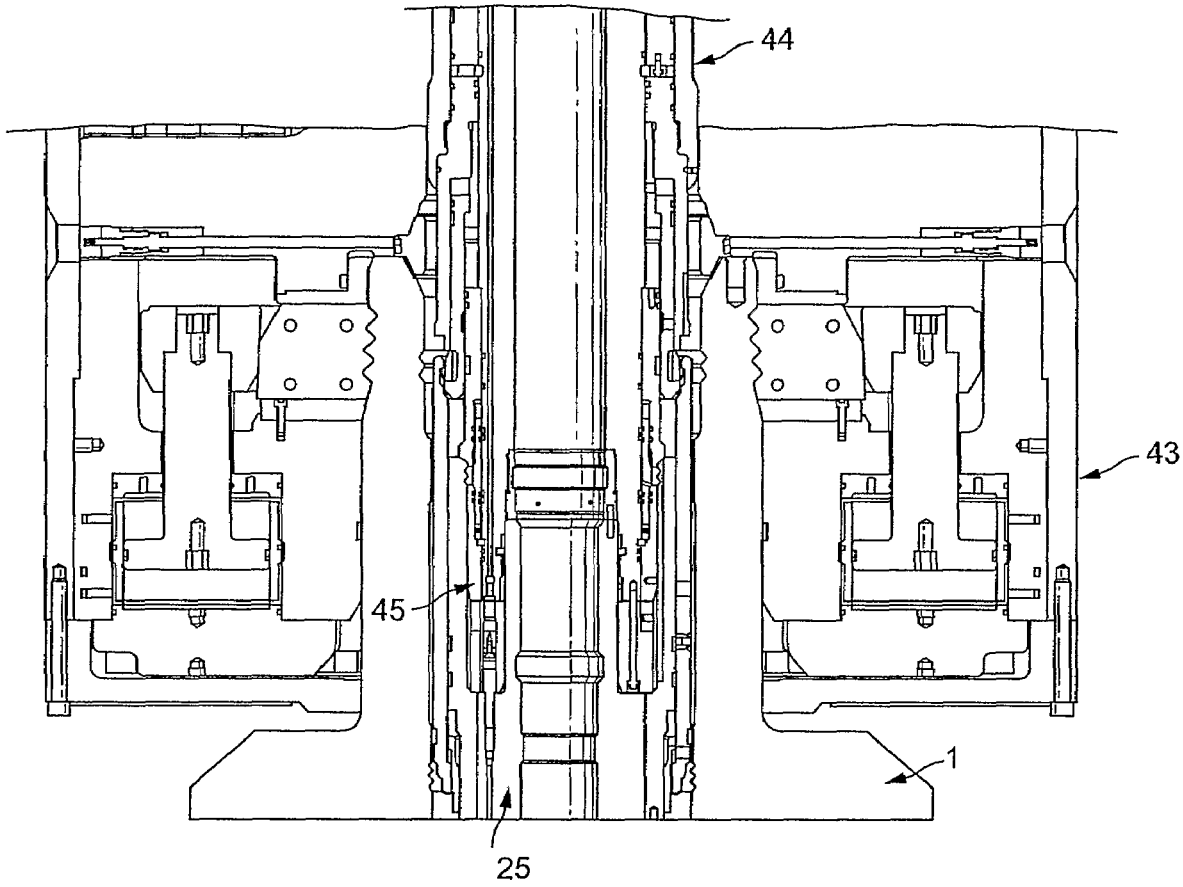
FIG. 4 is another partly sectioned view of a re-entry hub in conjunction with a BOP connector, illustrating a prior stage of operation.

FIG. 4 illustrates a stage of operation of the tree prior to the running of the cap. FIG. 4 shows the hub 1 and the adjacent part of a BOP (blow-out preventer ) connector 43, through which the tubing hanger 25 is run, by means of the tubing hanger running tool 44 into the tree.

When it is desired to monitor downhole functions while the tubing hanger 25 is being run communications may be relayed to the surface through electrical and hydraulic lines (denoted 45) in the tubing hanger running tool 44.

When the tubing hanger 25 has been landed inside the tree, and locked in place, it is customary to test it before the BOP connector 43 is removed. After the BOP connector 43 is removed the cap 2 may be run. Once the cap is locked in place the proximity of part of the cap 2 to the locking mechanism of the tubing hanger provides (as previously described with reference to FIG. 3) an independent locking means by virtue of the prevention of any movement of the tubing hanger's locking mechanism.

The invention claimed is:

1. A cap for a subsea tree having a re-entry hub having an outer periphery and an inner periphery, and for use with a tubing hanger deployed within the tree, the cap comprising an outer sleeve for fitment over said outer periphery of the hub and an inner sleeve adapted to extend within the hub and adjacent said inner periphery thereof, the inner sleeve supporting at least one annular seal which provides a barrier between said inner sleeve and said inner periphery of said hub, and said inner sleeve having communication lines extending therethrough and communication couplers connected to said communication lines and disposed for mating with corresponding couplers in the tubing hanger.

2. The cap of claim 1 in which said communication couplers are located at an extremity of the inner sleeve.

3. The cap of claim 2 in which the communication couplers include hydraulic couplers.

4. The cap of claim 2 in which the communication couplers include electrical couplers.

5. The cap of claim 4 in which the electrical couplers are wet-makeable conductive couplers.

6. The cap of claim 1 in which said seal is accommodated in an annular recess in an outer periphery of said inner sleeve.

7. The cap of claim 1 in which said outer sleeve includes releasable engagement fittings for securing said outer sleeve to said outer periphery of the hub.

8. The cap of claim 1 in which the cap includes a boss having an upwardly extending part adapted for attachment to a wire line.

9. A subsea tree including a re-entry hub having an outer periphery and an inner periphery and for use with a tubing hanger deployed within the tree, the tree including a cap comprising an outer sleeve for fitment over said outer periphery of the hub and an inner sleeve adapted to extend within the hub and adjacent said inner periphery thereof, the inner sleeve supporting at least one annular seal which provides a barrier between said inner sleeve and said inner periphery of said hub, and said inner sleeve having communication lines extending therethrough and communication couplers connected to said communication lines and disposed for mating with corresponding couplers in the tubing hanger.

10. The subsea tree of claim 9 in which said seal is accommodated in an annular recess in an outer periphery of said inner sleeve.

11. The subsea tree of claim 9 in which the cap includes a boss having an upwardly extending part adapted for attachment to a wire line.

* * * * *